US007882787B2

(12) United States Patent
Ganz

(10) Patent No.: US 7,882,787 B2
(45) Date of Patent: Feb. 8, 2011

(54) MACHINE FOR RENOVATION OF A TRACK

(75) Inventor: Jörg Ganz, Etoy (CH)

(73) Assignee: MATISA Matériel Industriel S.A., Crissier (CH)

( * ) Notice: Subject to any disclaimer, the term of this patent is extended or adjusted under 35 U.S.C. 154(b) by 495 days.

(21) Appl. No.: 11/660,441

(22) PCT Filed: Aug. 11, 2005

(86) PCT No.: PCT/IB2005/002614

§ 371 (c)(1),
(2), (4) Date: Feb. 15, 2007

(87) PCT Pub. No.: WO2006/021878

PCT Pub. Date: Mar. 2, 2006

(65) Prior Publication Data

US 2007/0261588 A1 Nov. 15, 2007

(30) Foreign Application Priority Data

Aug. 27, 2004 (CH) ..... 1410/04

(51) Int. Cl.
*E01B 29/05* (2006.01)

(52) U.S. Cl. ..... 104/2

(58) Field of Classification Search ..... 104/2, 104/4, 5, 6, 9
See application file for complete search history.

(56) References Cited

U.S. PATENT DOCUMENTS 4,253,398 A 3/1981 Theurer et al.
4,261,264 A * 4/1981 Theurer et al. ..... 104/6
4,275,659 A 6/1981 Theurer et al.
4,627,359 A * 12/1986 Buhler ..... 104/3

FOREIGN PATENT DOCUMENTS

DE 29 24 840 A1 3/1980

* cited by examiner

*Primary Examiner*—S. Joseph Morano
*Assistant Examiner*—Robert J McCarry, Jr.
(74) *Attorney, Agent, or Firm*—Frommer Lawrence & Haug LLP; Ronald R. Santucci

(57) ABSTRACT

The invention relates to a gantry crane of a machine, for the exchange of sleepers on a track, which may be displaced in a machine longitudinal direction on crane tracks. Two crane buggies on the gantry crane, at a separation from each other in the machine transverse direction are embodied such as to be displaced relative to the crane chassis by means of a displacement drive for altering the gauge. The corresponding crane tracks may be adjusted in the track transverse direction by drives to change the gauge.

9 Claims, 3 Drawing Sheets

Figure 1:
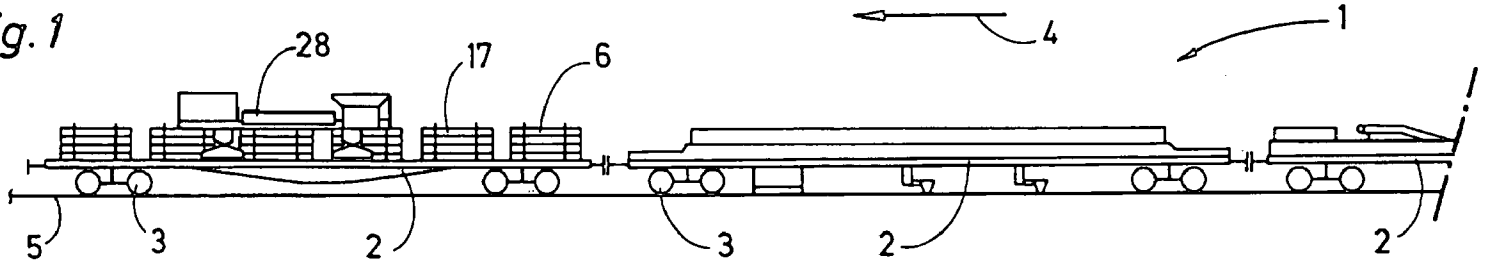

Fig. 6
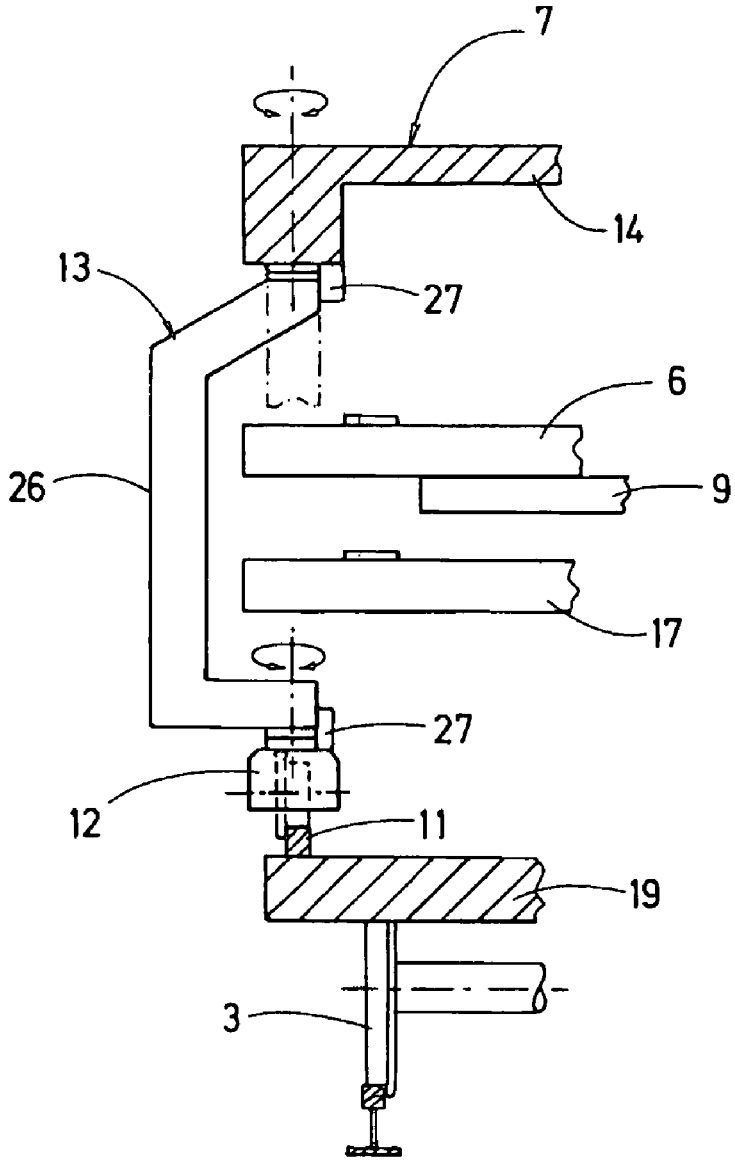
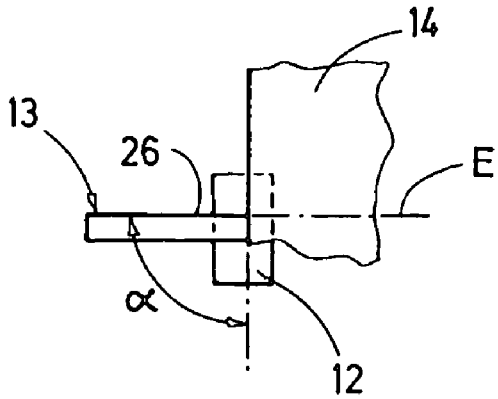
Fig. 7

MACHINE FOR RENOVATION OF A TRACK

This application is a 371 of PCT/IB2005/002614 filed on Aug. 11, 2005, published on Mar. 2, 2006 under publication number WO 2006/021878 A1 which claims priority benefits from Swiss Patent Application Number 01410/04 filed Aug. 27, 2004.

The invention relates to a machine for renewing a track formed from rails and sleepers, comprising a number of work wagons, which are coupled to one another, and crane rails, which are connected to the work wagons and on which a gantry crane which has traveling gears, sleeper-transporting apparatuses and a crane frame can be displaced in a longitudinal direction of the machine.

Such a machine is known, for example, from U.S. Pat. No. 4,275,659. The gantry crane can be displaced on the crane rails, irrespective of the continuous forward travel of the machine, in order to deliver new sleepers to a transporting arrangement.

The object of the present invention, then, is to provide a machine of the generic type which can readily be used even in the case of constricted railroad clearances.

This object is achieved according to the invention by a machine of the type mentioned in the introduction having the features cited in the characterizing part of claims 1 and 6.

Such a design of the gantry crane means that, even in the case of transverse sleepers, the gantry crane can readily be moved past the latter. For the transfer travel of the machine, the gantry crane can be changed over to a reduced width with a minimum of conversion work.

Further advantages and embodiments of the invention can be gathered from the rest of the claims and the drawing.

Figure 2:
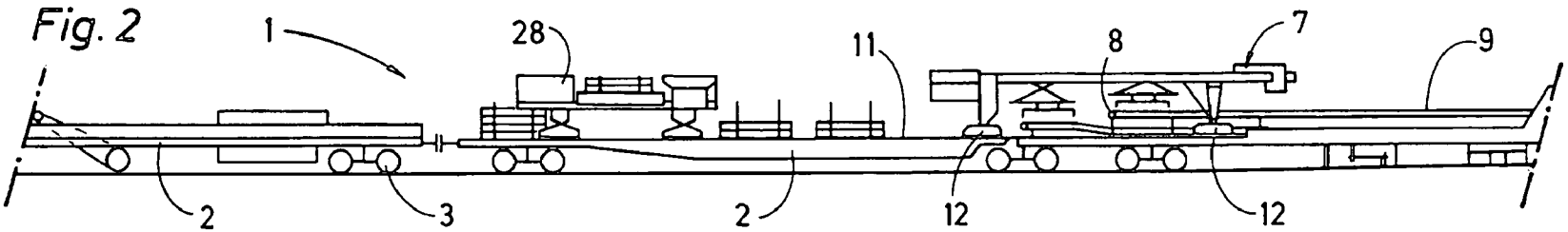
Figure 3:
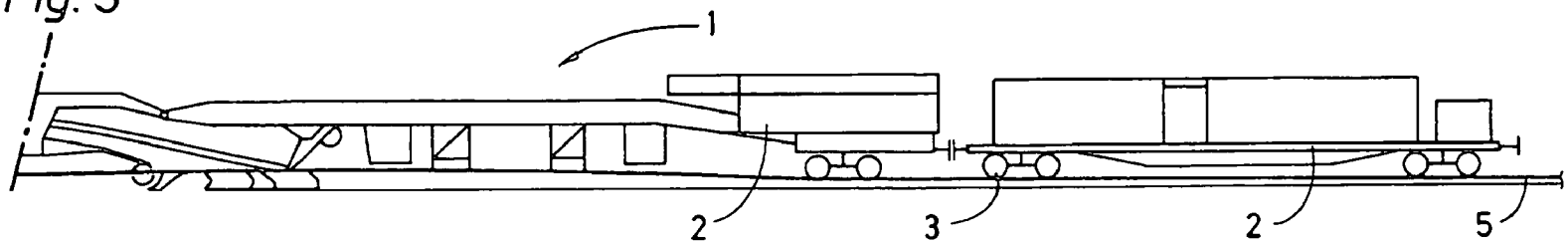
Figure 4:
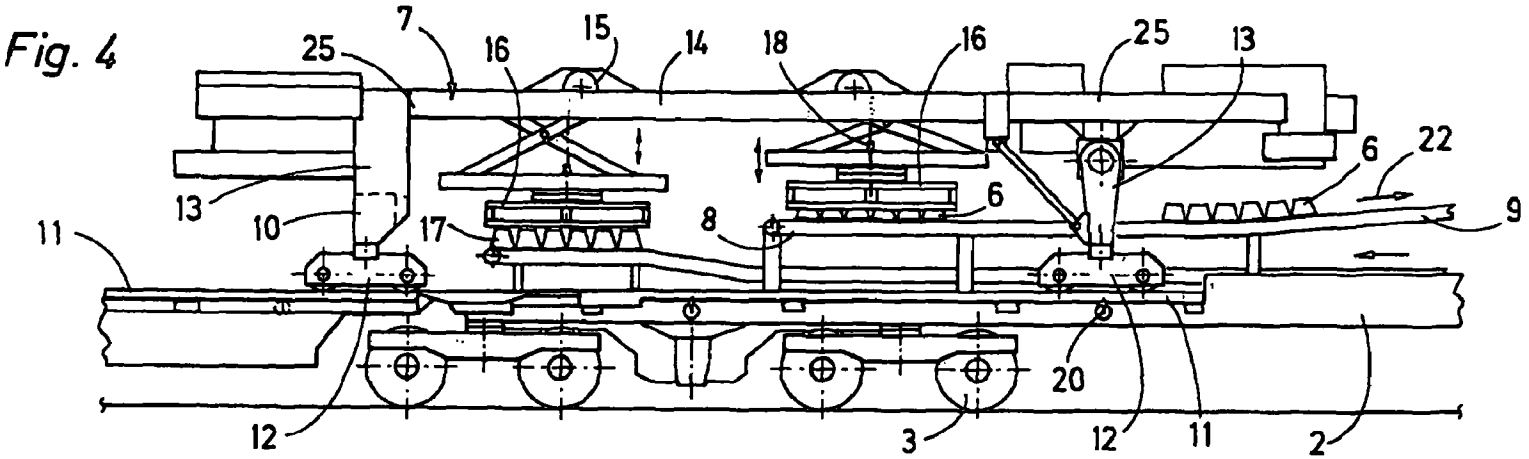
Figure 5:
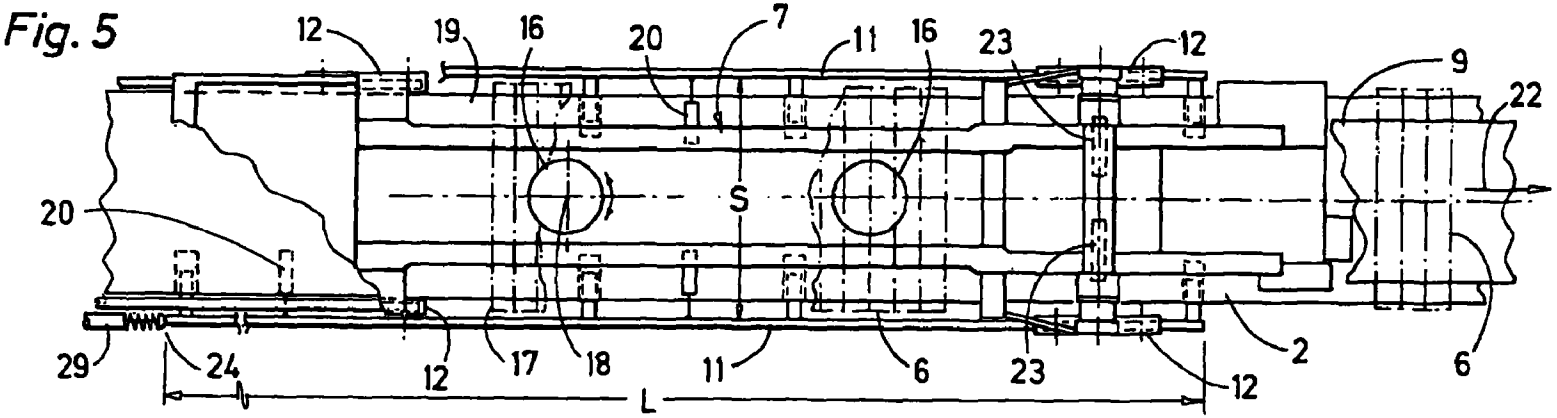

The invention is described in more detail hereinbelow with reference to exemplary embodiments illustrated in the drawing, in which:

FIGS. 1, 2 and 3 each show side views of a front, central and rear portion, respectively, of a track-renewing machine made up of a plurality of work wagons, FIGS. 4 and 5 show an enlarged illustration of a gantry crane in a side view and in plan view, respectively, and FIGS. 6 and 7 each show a schematic illustration of a further variant.

A machine 1, which can be seen in FIGS. 1 to 3 and is also referred to as a track-renewal train, is made up of a multiplicity of work wagons 2 which are coupled to one another and can be displaced on a track 5, in an operating direction 4, via rail-mounted traveling gears 3. New sleepers 6 are mounted at the front end of the machine 1 and these can be transported by a gantry crane 7 to a transfer end 8 of a new-sleeper conveyor 9 running in the longitudinal direction of the machine. The gantry crane 7, which has a traveling drive 10, can be displaced in the longitudinal direction of the machine, by means of four traveling gears 12 (FIG. 5), on two crane rails 11, which are spaced apart from one another by the distance of a gauge S and are connected to the work wagons 2.

As can also be seen, in particular, in FIGS. 4 and 5, the traveling gears 12 of the gantry crane 7 are connected to a crane frame 14 at a frame end 25 in each case by traveling-gear supports 13. Apparatuses 16 which can be adjusted in height by drives 15, can be rotated about a vertical axis 18 and are intended for transporting the new sleepers 6 and old sleepers 17 are located between the traveling-gear supports 13, as seen in the longitudinal direction of the machine.

In the region of the transfer end 8 of the new-sleeper conveyor 9, the two crane rails 11 are mounted on a frame 19 of the associated work wagon 2 such that they can be displaced transversely by drives 20 in a direction normal to the longitudinal direction of the machine. A length L of the two transversely displaceably mounted crane rails 11 corresponds at least to a distance which runs in the longitudinal direction of the machine between the two traveling gears 12 each arranged at one end 25 of the crane frame 14. The crane rails 11 which follow the transversely displaceable crane rails 11 are connected in a non-movable manner to the respective wagon frame 19. A fly-shunting apparatus 29 formed from a hydraulic drive serves for accelerating the forward travel of the gantry crane 7 in a transporting direction 22 of the new sleepers 6.

Of the total of four traveling gears 12, it is only the two front traveling gears 12—as seen in the transporting direction 22—which are designed so as to be capable of being changed in respect of their gauge (S). For this purpose, the two front traveling-gear supports 13 are mounted in a transversely displaceable manner on the crane frame 14 and are each connected to a displacement drive 23.

During transfer of the machine 1 to the construction site, the two transversely displaceable crane rails 11 and the two transversely adjustable traveling gears 12 are spaced apart from one another by a distance which corresponds to the gauge between the non-movable crane rails 11. This gauge is smaller than the length of the new sleepers 6. As soon as the construction site has been reached, the drives 20 for displacing the moveable crane rails 11 transversely, and the displacement drives 23 for displacing the front traveling gears 12 transversely, are activated. The thus extended gauge S is slightly larger than the length of the new sleeper 6. It is thus possible for the gantry crane 7, once it has deposited the new sleepers 6, rotated into the transverse position, at the transfer end 8 of the new-sleeper conveyor 9, to be displaced back without obstruction—counter to the transporting direction 22—in order to deposit the old sleepers 17 which have been picked up and to pick up new sleepers 6 again. This return travel is terminated as soon as the transversely moveable traveling gears 12 have reached a rear end 24 of the moveable crane rails 11. Throughout the forward and return travel of the gantry crane 7, the non-moveable traveling gears 12 are located on the non-displaceable crane rails 11. It is possible to displace further gantry cranes 28 thereon for sleeper-transporting purposes.

According to a variant of the gantry crane 7 which is illustrated schematically in FIGS. 6 and 7, the front traveling-gear supports 13—as seen in the transporting direction 22—have an angled portion 26 which runs along a plane E. This angled portion is designed such that it can be rotated by a drive 27 at an angle $\alpha$ of 90° relative to the crane frame 14 and traveling gear 12. It is thus possible—without any transverse displacement of the traveling gears 12 and of the crane rails 11—to provide a wider area, in a cross section of the gantry crane 7, which, despite the wide new sleeper 6, allows the gantry crane 7 to travel back and forth without obstruction. All that is required for this purpose is for the angled portion 26, which is positioned in the region of the transfer end 8 of the new-sleeper conveyor 9, to be rotated from the transfer position, which is illustrated by chain-dotted lines, into an operating position.

The invention claimed is:

1. A machine for renewing a track formed from rails and sleepers, comprising a number of work wagons, which are coupled to one another, and crane rails, which are connected to the work wagons and on which a gantry crane which has traveling gears sleeper-transporting apparatuses and a crane frame can be displaced in a longitudinal direction of the machine, and wherein two crane rails which are located opposite one another in the transverse direction of the machine are mounted such that they can be displaced by drives in the transverse direction of the machine relative to a wagon frame, wherein two traveling gears of the gantry crane which are spaced apart from one another in a transverse direction of the machine to form a gauge are designed such that they can be displaced relative to the crane frame by a displacement drive in order to change the gauge.

2. The machine as claimed in claim 1, wherein a transfer end of a new-sleeper conveyor, which is provided for transporting new sleepers and runs in the longitudinal direction of the machine, is provided between the two transversely displaceably mounted crane rails.

3. The machine as claimed in claim 1, wherein the length of the two transversely displaceably mounted crane rails corresponds at least to a distance which runs in the longitudinal direction of the machine between the two traveling gears each arranged at one end of the crane frame.

4. The machine as claimed in claim 1, wherein, of the total of four traveling gears, it is only the two front traveling gears—as seen in a transporting direction of the new sleepers—which are designed so as to be capable of being changed in respect of their gauge.

5. A machine for renewing a track formed from rails and sleepers, comprising a number of work wagons, which are coupled to one another, and crane rails, which are connected to the work wagons and on which a gantry crane which has traveling gears, sleeper-transporting apparatuses and a crane frame can be displaced in a longitudinal direction of the machine, wherein a traveling-gear support, which is connected to the crane frame and the traveling gear, has an angled portion which runs along a plane and is designed such that it can be rotated by a drive at an angle $\alpha$ of 90° relative to the crane frame and traveling gear.

6. The machine as claimed in claim 2, wherein the length of the two transversely displaceably mounted crane rails corresponds at least to a distance which runs in the longitudinal direction of the machine between the two traveling gears each arranged at one end of the crane frame.

7. The machine as claimed in claim 1, wherein, of the total of four traveling gears, it is only the two front traveling gears—as seen in a transporting direction of the new sleepers—which are designed so as to be capable of being changed in respect of their gauge.

8. The machine as claimed in claim 2, wherein, of the total of four traveling gears, it is only the two front traveling gears—as seen in a transporting direction of the new sleepers—which are designed so as to be capable of being changed in respect of their gauge.

9. The machine as claimed in claim 3, wherein, of the total of four traveling gears, it is only the two front traveling gears—as seen in a transporting direction of the new sleepers—which are designed so as to be capable of being changed in respect of their gauge.

* * * * *